US007964551B2

(12) United States Patent
Shah et al.

(10) Patent No.: US 7,964,551 B2
(45) Date of Patent: Jun. 21, 2011

(54) CLEANING TABLET

(75) Inventors: Purvita Shah, Jersey City, NJ (US); David K. Hood, Basking Ridge, NJ (US); Michael J. Jurek, Jefferson Township, NJ (US)

(73) Assignee: ISP Investments Inc., Wilmington, DE (US)

( * ) Notice: Subject to any disclaimer, the term of this patent is extended or adjusted under 35 U.S.C. 154(b) by 205 days.

(21) Appl. No.: 11/731,972

(22) Filed: Apr. 2, 2007

(65) Prior Publication Data

US 2007/0238635 A1 Oct. 11, 2007

Related U.S. Application Data

(60) Provisional application No. 60/788,454, filed on Mar. 31, 2006.

(51) Int. Cl.
*C11D 17/00* (2006.01)
*C11D 7/38* (2006.01)

(52) U.S. Cl. ..... 510/446; 510/224; 510/298; 510/475; 510/478; 510/509

(58) Field of Classification Search ..... 510/446, 510/224, 298, 475, 478, 509
See application file for complete search history.

(56) References Cited

U.S. PATENT DOCUMENTS

| | | | | |
|---|---|---|---|---|
| 3,772,431 | A * | 11/1973 | Mlkvy et al. | 424/44 |
| 5,008,106 | A * | 4/1991 | Merianos et al. | 424/78.06 |
| 5,645,848 | A * | 7/1997 | De et al. | 424/408 |
| 6,723,135 | B2 * | 4/2004 | Eskuchen et al. | 8/137 |
| 2004/0052826 | A1 * | 3/2004 | Fernandez-Kleinlein et al. | 424/401 |

* cited by examiner

*Primary Examiner* — Lorna M Douyon
(74) *Attorney, Agent, or Firm* — William J. Davis; Thompson Hine LLP

(57) ABSTRACT

A cleaning tablet comprising a hydrogen-bonded complex of poly(N-vinyl pyrrolidone) containing, by weight, about 15-20 wt. % $H_2O_2$, and ingredients capable of producing an effervescent effect in aqueous solution by release of carbon dioxide therefrom which comprises an alkali carbonate and/or bicarbonate base and an organic acid.

7 Claims, No Drawings

CLEANING TABLET

CROSS-REFERENCE TO RELATED APPLICATION

The present application claims the benefit of U.S. Provisional Application Ser. No. 60/788,454, filed on Mar. 31, 2006, which is incorporated herein by reference thereto.

FIELD OF THE INVENTION

This invention relates to cleaning products, and, more particularly to tablets having a high concentration of stable peroxide and ingredients capable of producing an effervescent effect upon dissolution in aqueous solution.

BACKGROUND OF THE INVENTION

Industry has trended toward oxygen-cleaning products for spot cleaning application, particularly stable liquid peroxide-containing cleaning formulations. Also it is desired to introduce the peroxide in a tablet which can be dissolved in an aqueous solution to form the peroxide cleaning composition. A product which can provide effervescence during cleaning is considered an advantage.

SUMMARY OF THE INVENTION

A cleaning tablet comprising a hydrogen-bonded complex of poly(N-vinyl pyrrolidone) containing, by weight, about 15-20 wt. % $H_2O_2$, and ingredients capable of producing an effervescent effect in aqueous solution by release of carbon dioxide therefrom which comprises an alkali carbonate and/or bicarbonate base and an organic acid.

A cleaning tablet which contains about 6-11 wt. % hydrogen peroxide.

A cleaning tablet wherein said alkali carbonate and/or bicarbonate is selected from sodium carbonate or potassium carbonate, sodium bicarbonate and potassium bicarbonate, and said organic acid is selected from citric, malic, tartaric, adipic and fumaric acid.

A cleaning tablet wherein the wt. ratio of base to acid thereon is about 1:1.

A cleaning tablet which also includes a disintegrant ingredient.

A cleaning tablet wherein said disintegrant is Polyclar Super R or Disintex-75.

A cleaning tablet having a rapid dissolution time in aqueous solution.

DETAILED DESCRIPTION OF THE INVENTION

In one embodiment of the invention there is provided herein a peroxide tablet containing capable of producing an effervescent effect upon dissolution in water. A suitable peroxide source is Peroxydone® K-30 (ISP) which is a hydrogen bonded complex of poly(N-vinyl pyrrolidone) containing 15-20 wt. % $H_2O_2$. Suitably the tablet contains a high concentration of Peroxydone® K-30, preferably about 40-50 wt. % Peroxydone® K-30. The tablet also contains ingredients which can effervesce when dissolved in water. Suitable of such ingredients are a base, e.g. an alkali metal carbonate and/or bicarbonate, e.g. sodium carbonate, potassium carbonate and/or sodium bicarbonate or potassium bicarbonate, and an organic acid, e.g. citric, malic, tartaric adipic or tartaric acid. Preferably such base and acid are present in about a 1:1 wt. ratio. When the tablet is dissolved the interaction of base and acid results in the release of carbon dioxide, subsequently increases the rate of disintegration of the Peroxydone® K-30 and other ingredients present in the tablet.

Dissolution Test

Each tablet contained 1 g formulation, which was hand mixed.

The powder was compressed into a tablet using a pressure of 800 lb for the 1 g tablet, and a dwell time of 1 second on a Carver Automated tablet press.

Tablet was placed in a mesh-wire basket and then submerged in 800 mL of distilled water at 25° C. It was kept in the water until complete dissolution or a maximum of 10 minutes.

For tablets that did not completely disintegrate before 10 min, a second mass was taken of the dry residue and a dissolution rate (g/min) was calculated.

Calculation of Dissolution Rate $$\text{Dissolution Rate (g/min)} = (\text{Tablet}_{Initial\ Weight(g)} - \text{Tablet}_{Final\ Weight(g)})/\text{Dissolution Time (min.)}$$

Results and Discussion

An effervescent tablet formulation containing a balanced ratio of acid with sodium bicarbonate was used to formulate at least 40-50% Peroxydone® K-30 with other ingredients. Formulation is compressed into a tablet and it is tested for dissolution. While the tablet dissolved in water, the interaction of the acid and base resulted in the release of carbon dioxide, subsequently increased the rate of disintegration of the Peroxydone K-30 and other additives. Concentrations of ingredients were used in wt % and the abbreviations of all ingredients used in these tablet formulations are listed in Table I.

TABLE I

| |
|---|
| PK30 - Peroxydone K-30 |
| NaBC - Sodium Bicarbonate |
| CC - Calcium Carbonate |
| CA - Citric Acid |
| TA - Tartaric Acid |
| NaCl - Sodium Chloride |
| SLS - Sodium Lauryl Sulfate |
| EW20 - EasyWet-20 |
| MA - Malic Acid |
| FA - Fumaric Acid |
| AA - Alginic Acid |
| CS - Calcium Silicates |
| SS - Sodium Silicates |
| CAce - Calcium Acetate |
| EG - Ethylene glycol |
| UCon Lubricant 50-HB-660 - Dow |
| PSR - Polyclar Super R |
| D-75 - Disintex-75 |
| D-200 - Disintex-200 |
| PEG600 - Polyethylene glycol |
| PG - Propylene glycol |
| KAce - Potassium Acetate |
| Gly - Glycerine |

The tablet test was conducted using a wide range of additives in various ratios to formulate the Peroxydone K-30 tablets. Peroxydone K-30 was tableted at a concentration of 50 wt. % and 40 wt. %. Tablets formulated with 50 wt. % PK-30 gave slow dissolution times, with a maximum dissolution of 5.15 m·s. The results are listed in Table II. The test tablets did not include any disintegrants in the formulation.

TABLE II

| (50% Peroxydone) | | |
|---|---|---|
| Composition | Time (min · sec) | Rate (g/min) |
| PK-30(50%) + CC-Aldrich(30%) + TA(20%) | >10 | 0.068 |
| PK-30(50%) + NaBC(30%) + TA(15%) + D-75(5%) | >10 | 0.095 |
| PK-30(50%) + NaBC(30%) + TA(15%) + EW20(5%) | >10 | 0.076 |
| PK-30(50%) + NaBC(25%) + TA(25%) | 9.1 | 0.11 |
| PK-30(50%) + NaBC(30%) + TA(15%) + D-75 (2.5%) + PEG600(2.5%) | 5.45 | 0.17 |
| PK-30(50%) + NaBC(30%) + TA(18%) + PEG600(2%) | 5.3 | 0.18 |
| PK-30(50%) + NaBC(30%) + TA(15%) + PEG600(5%) | 5.15 | 0.19 |
| PK-30(50%) + NaBC(25%) + TA(15%) + PEG600(10%) | 5.45 | 0.17 |
| Tablet weights were 1 g. | | |

Tablets formulated with 40 wt. % PK-30 gave faster dissolution times, with a maximum dissolution of 1.21 m·s; the results are listed in Table III. Higher amounts of base and acid did not improve dissolution times; a balanced ratio of 1:1 acid to base gave faster dissolution times. To this a disintegrant added tablet improved the dissolution time. Polyclar Super R having a slightly higher particle size is a better disintegrant then Disintex-75 for this particular tablet formulation.

TABLE III

| (40% Peroxydone) | | |
|---|---|---|
| Composition | Time (min · sec) | Rate (g/min) |
| PK-30(40%) + NaBC(20%) + TA(20%) + SLS (10%) + PEG600(10%) | >10 | 0.075 |
| PK-30(40%) + NaBC(25%) + TA(25%) + Gly(10%) | 7.2 | 0.3 |
| PK-30(40%) + NaBC(25%) + TA(25%) + UCon(10%) | 6.15 | 0.16 |
| PK-30(40%) + NaBC(10%) + TA(40%) + PEG600(10%) | 5 | 0.2 |
| PK-30(40%) + NaBC(15%) + TA(35%) + PEG600(10%) | 3.45 | 0.27 |
| PK-30(40%) + NaBC(35%) + TA(15%) + PEG600(10%) | 3.36 | 0.28 |
| PK-30(40%) + NaBC(20%) + TA(30%) + PEG600(10%) | 3.23 | 0.3 |
| PK-30(40%) + NaBC(25%) + TA(25%) + PG(10%) | 3.1 | 0.32 |
| PK-30(40%) + NaBC(25%) + TA(12.5%) + MA(12.5%) + PEG600(10%) | 3.2 | 0.3 |
| Effect of Concentration of Acid and Base | | |
| PK-30(40%) + NaBC(35%) + TA(15%) + PEG600(10%) | 3.35 | 0.26 |
| PK-30(40%) + NaBC(25%) + TA(25%) + PEG600(10%) | 3.12 | 0.31 |
| PK-30(40%) + NaBC(20%) + TA(30%) + PEG600(10%) | 3.23 | 0.3 |
| PK-30(40%) + NaBC(15%) + TA(35%) + PEG600(10%) | 3.45 | 0.27 |
| PK-30(40%) + NaBC(10%) + TA(40%) + PEG600(10%) | 5 | 0.2 |

TABLE III-continued

| (40% Peroxydone) | | |
|---|---|---|
| | Time (min · sec) | Rate (g/min) |
| Tablet with Disintegrant | | |
| PK-30(40%) + NaBC(25%) + TA(20%) + D-75(10%) + PEG600(5%) | 2.3 | 0.4 |
| PK-30(40%) + NaBC(25%) + Tartaric Acid(20%) + D-200(10%) + PEG600(5%) | 4 | 0.25 |
| PK-30(40%) + NaBC(25%) + TA(20%) + PSR(10%) + PEG600(5%) | 1.27 | 0.69 |

The third tablet performed best (1.27 m·sec) above repeated 5 times for data consistency. The average dissolution of 5 such tablets was 1.21 m·s. These results are given in Table IV.

TABLE IV

| (40% Peroxydone) | | |
|---|---|---|
| Composition | Time (min · sec) | Rate (g/min) |
| PK-30(40%) + NaBC(25%) + TA(20%) + PSR(10%) + PEG600(5%) | 1.27 | 0.69 |

What is claimed:

1. A cleaning tablet comprising a hydrogen-bonded complex of poly(N-vinyl pyrrolidone) containing, by weight, about 15-20 wt. % $H_2O_2$, a disintegrant and ingredients capable of producing an effervescent effect in aqueous solution by release of carbon dioxide therefrom which comprises an alkali carbonate and/or bicarbonate base and an organic acid, wherein the hydrogen-bonded complex of poly(N-vinyl pyrrolidone) is present at a concentration from about 40-50% by weight of the tablet.

2. A cleaning tablet according to claim 1 wherein said alkali carbonate and/or bicarbonate is selected from sodium carbonate, potassium carbonate, sodium bicarbonate and potassium bicarbonate.

3. A cleaning tablet according to claim 1 wherein the wt. ratio of base to acid therein is about 1:1.

4. A cleaning tablet according to claim 1 having a rapid dissolution time in aqueous solution.

5. A cleaning tablet according to claim 1 wherein said organic acid is selected from the group consisting of citric, malic, tartaric, adipic and fumaric.

6. A cleaning tablet according to claim 5 wherein the organic acid is tartaric acid.

7. A cleaning tablet comprising a hydrogen-bonded complex of poly(N-vinyl pyrrolidone) containing, by weight, about 6-11 wt % $H_2O_2$, a disintegrant and ingredients capable of producing an effervescent effect in aqueous solution by release of carbon dioxide therefrom which comprises an alkali carbonate and/or bicarbonate base and an organic acid, wherein the hydrogen-bonded complex of poly(N-vinyl pyrrolidone) is present at a concentration from about 40-50% by weight of the tablet.

* * * * *